US009366264B2

(12) United States Patent
Parker

(10) Patent No.: US 9,366,264 B2
(45) Date of Patent: Jun. 14, 2016

(54) VARIABLE GEOMETRY TURBINE

(71) Applicant: Cummins Ltd., Huddersfield (GB)

(72) Inventor: John F. Parker, Huddersfield (GB)

(73) Assignee: CUMMINS LTD, Huddersfield (GB)

( * ) Notice: Subject to any disclaimer, the term of this patent is extended or adjusted under 35 U.S.C. 154(b) by 719 days.

(21) Appl. No.: 13/675,490

(22) Filed: Nov. 13, 2012

(65) Prior Publication Data

US 2013/0223996 A1 Aug. 29, 2013

(30) Foreign Application Priority Data

Nov. 10, 2011 (GB) ..... 1119386.9

(51) Int. Cl.

| | |
|---|---|
| ***F01D 17/12*** | (2006.01) |
| ***F04D 29/08*** | (2006.01) |
| ***F04D 27/00*** | (2006.01) |
| ***F01D 17/14*** | (2006.01) |
| ***F01D 17/16*** | (2006.01) |
| ***F04D 27/02*** | (2006.01) |

(52) U.S. Cl.

CPC ..... *F04D 29/083* (2013.01); *F01D 17/141* (2013.01); *F01D 17/167* (2013.01); *F04D 27/002* (2013.01); *F04D 27/0246* (2013.01); *F05D 2220/40* (2013.01)

(58) Field of Classification Search

CPC ..... F01D 17/14; F01D 17/16; F01D 17/165; F05D 2270/3061

USPC ..... 415/158, 164, 165

See application file for complete search history.

(56) References Cited

U.S. PATENT DOCUMENTS

2002/0098080 A1 7/2002 Arnold

FOREIGN PATENT DOCUMENTS

| | | | |
|---|---|---|---|
| EP | 0678657 | A2 | 10/1995 |
| GB | 2459314 | A | 10/2009 |
| WO | WO/03/023194 | A1 | 3/2003 |
| WO | WO/2007/031752 | A1 | 3/2007 |

OTHER PUBLICATIONS

European Search Report from counterpart EP Application No. EP12191878 dated Mar. 14, 2013 (2 pages).

United Kingdom Search Report, GB1119386.9, Cummins Ltd., Feb. 10, 2012.

*Primary Examiner* — Edward Look

*Assistant Examiner* — Jason Mikus

(74) *Attorney, Agent, or Firm* — Taft Stettinius & Hollister LLP

(57) ABSTRACT

A variable geometry turbine has a gas flow control mechanism located upstream of the turbine wheel and operable by an actuator assembly to control gas flow through said inlet passage. The control mechanism comprises a movable member for varying the size of the inlet passage. The movable member is coupled to a pair of rods that translate in an axial direction. The rods are supported for translation in guide bushes. A seal assembly seals against each rod and comprises a seal carrier coupled to an end of the guide bush. The seal carrier carries a lip seal that is in sealing contact with an external surface of the rod.

20 Claims, 4 Drawing Sheets

VARIABLE GEOMETRY TURBINE

CROSS REFERENCE TO RELATED APPLICATIONS

The present application claims priority to United Kingdom Patent Application No. 1119386.9 filed Nov. 10, 2011, which is incorporated herein by reference.

The present invention relates to a variable geometry turbine and to a turbomachine, such as a turbocharger, incorporating such a turbine.

Turbochargers are well known devices for supplying air to the intake of an internal combustion engine at pressures above atmospheric (boost pressures). A conventional turbocharger essentially comprises an exhaust gas driven turbine wheel mounted on one end of a rotatable shaft and within a turbine housing. At the other end of the shaft a compressor impeller is supported for rotation within a compressor housing. The flow of exhaust gas through the turbine wheel drives it in rotation which in turn causes rotation of the compressor impeller within the compressor housing. Rotation of the compressor impeller delivers compressed air to the engine intake manifold. The turbocharger shaft is conventionally supported by journal and thrust bearings, including appropriate lubricating systems, located within a central bearing housing connected between the turbine and compressor wheel housing.

In known turbochargers, the turbine stage comprises a turbine chamber defined by the turbine housing and within which the turbine wheel is mounted, an annular inlet passageway arranged around the turbine chamber, an inlet arranged around the inlet passageway, and an outlet passageway extending from the turbine chamber. The passageways and chambers communicate such that pressurised exhaust gas admitted to the inlet chamber flows through the inlet passageway to the outlet passageway via the turbine chamber and rotates the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands.

In one common type of variable geometry turbine, one wall of the inlet passageway is defined by a movable wall. The position of the movable wall relative to a facing wall of the inlet passageway is adjustable to control the width of the inlet passageway. For instance, as gas flowing through the turbine decreases the inlet passageway width may also be decreased to maintain gas velocity and optimise turbine output. Typically one of the walls is provided with vanes and is referred to as a "nozzle ring". The vanes extend into the inlet passageway and through slots provided on the other wall (referred to as the "shroud") of the inlet passageway. One of the nozzle ring and the shroud is movable in order to varying the size of the inlet passageway.

The nozzle ring is generally supported on rods extending parallel to the axis of rotation of the turbine wheel and is moved by an actuator, which is operable to displace the rods in an axial direction. Various types of actuators may be used to move the nozzle ring including, for example, a pneumatic actuator or a motor and gear transmission which are generally mounted on the outside of the housing. The actuator is coupled to the nozzle ring by a yoke pivotally supported on a shaft that is journalled in the housing, the yoke defining two spaced apart elongate arms which extend on opposite sides of the turbine axis to engage portions of the support rods extending outside the housing. Axial movement of the nozzle ring can be effected by rotation of the yoke about the shaft.

Each rod slides axially within a guide bush that is received in the bearing housing. Immediately adjacent to the guide bush, at the end opposite nozzle ring, an annular dynamic seal extends between the rod and the bearing housing so as to seal on to the other. This prevents the flow of oil along the rod to the turbine.

The seals for the rods are costly to install. First the bearing housing, which is typically as cast component, has to be machined using a bespoke milling cutter to produce and prepare the seal surfaces. The machining tolerances are relatively small and the surfaces are finished to a particular specification. A range of tooling is required for subsequent insertion to ensure that the seals are not over-pressed and are undamaged during the assembly process.

Turbocharger shafts may rotate at speeds of over 150,000 rpm, generating significant heat in the bearing housing. If the engine is switched off without allowing the turbocharger to cool for a short period first (known as "hot shut down") the bearings and the surrounding bearing housing become particularly hot. This is because turning off the engine removes the power to the oil pressurisation device (e.g. a pump) and the oil therefore does not circulate in the bearing housing whilst the turbocharger shaft is still rotating at high speeds. The heat generated by such rotation is dissipated through the bearing housing to the nozzle ring rods, which are therefore designed to withstand the relatively high temperatures.

It is one object of the present invention to obviate or mitigate the aforesaid disadvantages. It is also an object of the present invention to provide for an improved or alternative variable geometry turbine.

According to a first aspect of the present invention there is provided a variable geometry turbine comprising a turbine wheel mounted within a housing for rotation about a turbine axis, a gas flow inlet passage upstream of said turbine wheel, and a gas flow control mechanism located upstream of the turbine wheel and operable by an actuator assembly to control gas flow through said inlet passage, the control mechanism comprising a movable member for varying the size of the inlet passage, the movable member being coupled to at least one support member, a guide member providing support for movement of the at least one support member in translation, a seal assembly for sealing against the at least one support member, the seal assembly comprising a seal carrier coupled to the guide member, the seal carrier carrying a seal that is in sealing contact with the at least one support member.

The provision of a seal carrier that is coupled (e.g. connected or joined) to the guide member helps to ensure the seal is accurately positioned relative to the at least one support member without the need to prepare the surface of a surrounding housing. For example, the seal carrier may ensure that an annular or partly annular seal is concentric with the at least one support member. It may also allow the seal to be thermally decoupled from surrounding components. Furthermore it may provide a relatively simple and cost-effective way of locating the seal.

The seal carrier may be coupled to the guide member directly or via an intermediate coupling element. The seal carrier may be releasably coupled to the guide member. It may be so coupled, for example, by means of an interference (friction) or press fit. In one embodiment the seal carrier is coupled such that it is supported on the guide member. The intermediate coupling element may be in the form of a thermally insulating material or at least a material with a thermal conductivity lower than the housing. The coupling element may be in the form of a sleeve. The coupling element may be interposed between the seal carrier and the guide member, preferably in a radial clearance between the two.

The releasable coupling of the seal carrier to the guide member allows the seal assembly to be removed easily for inspection or replacement without causing damage.

The seal carrier may be coupled to a first end of the guide member. The seal carrier may have a first portion that is coupled to the guide member, preferably to the first end of the guide member. The seal carrier may have a second portion for supporting the seal. The second portion may have a diameter that is larger than the diameter of the first portion. The first and second portions may extend in a substantially axial direction. The first and second portions may be joined by an intermediate portion that may extend in a substantially radial direction. The intermediate portion may be integrally formed with the first and second portions.

The seal carrier may be substantially tubular and may be substantially circular in cross-section.

The seal carrier or the guide member may define a stop surface for limiting axial relative movement of the seal carrier and the guide member. The stop surface may be defined by the guide member. The first end of the guide member may have a diameter that is smaller than that of an adjacent portion of the guide member such that step transition is defined, the step transition defining the stop surface. Alternatively the stop surface may be defined on an end of the carrier by, for example, a flange or the like.

The support member is preferably translatable in a direction substantially parallel to the turbine axis.

The seal may comprise a lip seal having a lip that seals against a surface of the support member, preferably an outer surface of the support member. The seal may comprise a radially inner portion and a radially outer portion, the lip being defined on the radially inner portion. The inner portion may extend in a substantially axial direction and the outer portion may extend in a substantially radial direction. The outer portion may extend from one end of the inner portion.

The outer portion of the seal may be supported on a strengthening member, which may be in the form of a web. The strengthening member may comprise a first portion coupled to the seal carrier and a second portion that supports the seal. The first portion of the strengthening member may extend in a substantially axial direction whereas the second portion may extend in a substantially radial inwards direction. The strengthening member may be releasably coupled to the seal carrier by, for example, an interference (friction) or press fit, or may an intermediate coupling element. The first portion of the strengthening member may be coupled to the seal carrier, preferably to the second portion of the seal carrier. Alternatively it may be permanently fixed by a fixing member or by bonding, welding or the like.

The seal may be biased into contact with the guide member by means of a biasing member, for example. The biasing member may be annular and may be in the form of a spring, such as, for example, a garter spring.

The support member may be in the form of a rod which may be substantially cylindrical and arranged for axial translation along its length. The support member may be received within the guide member. There may be a pair of such rods, one on each side of the turbine axis, each having a seal assembly.

The movable member may be coupled to a first end of the support member and the seal assembly may be disposed at or near a second end of the support member.

The support member may be slidably disposed within the guide member. The guide member may be in the form of a bush which may be a hollow cylinder.

The guide member may be disposed in a bore in a housing, which may be a bearing housing. The bearing housing houses bearings for supporting rotation of a shaft to which the turbine wheel is connected. An outer surface of the seal carrier may abut a surface of the housing.

The seal carrier may have a thermal conductivity that is lower than that of the housing.

The support member may be a substantially cylindrical member; the guide bush may be a hollow substantially cylindrical member. The support member may be slidably received for translation.

The movable member may be a substantially annular wall member that may have a central axis arranged to be substantially coaxial with the axis of the turbine.

The movable member may be disposed opposite a facing wall of the housing, the distance between the movable member and the facing wall determining the size of the gas flow inlet passage.

The substantially annular wall member may support an array of vanes that extend in a direction away from the at least one support member. The vanes may extend in a direction substantially parallel to the axis of the turbine.

According to a second aspect of the present invention there is provided a turbomachine having a turbine as defined above. The turbomachine may be a turbocharger.

Specific embodiments of the present invention will now be described, by way of example only, with reference to the accompanying drawings in which.

Figure 1:
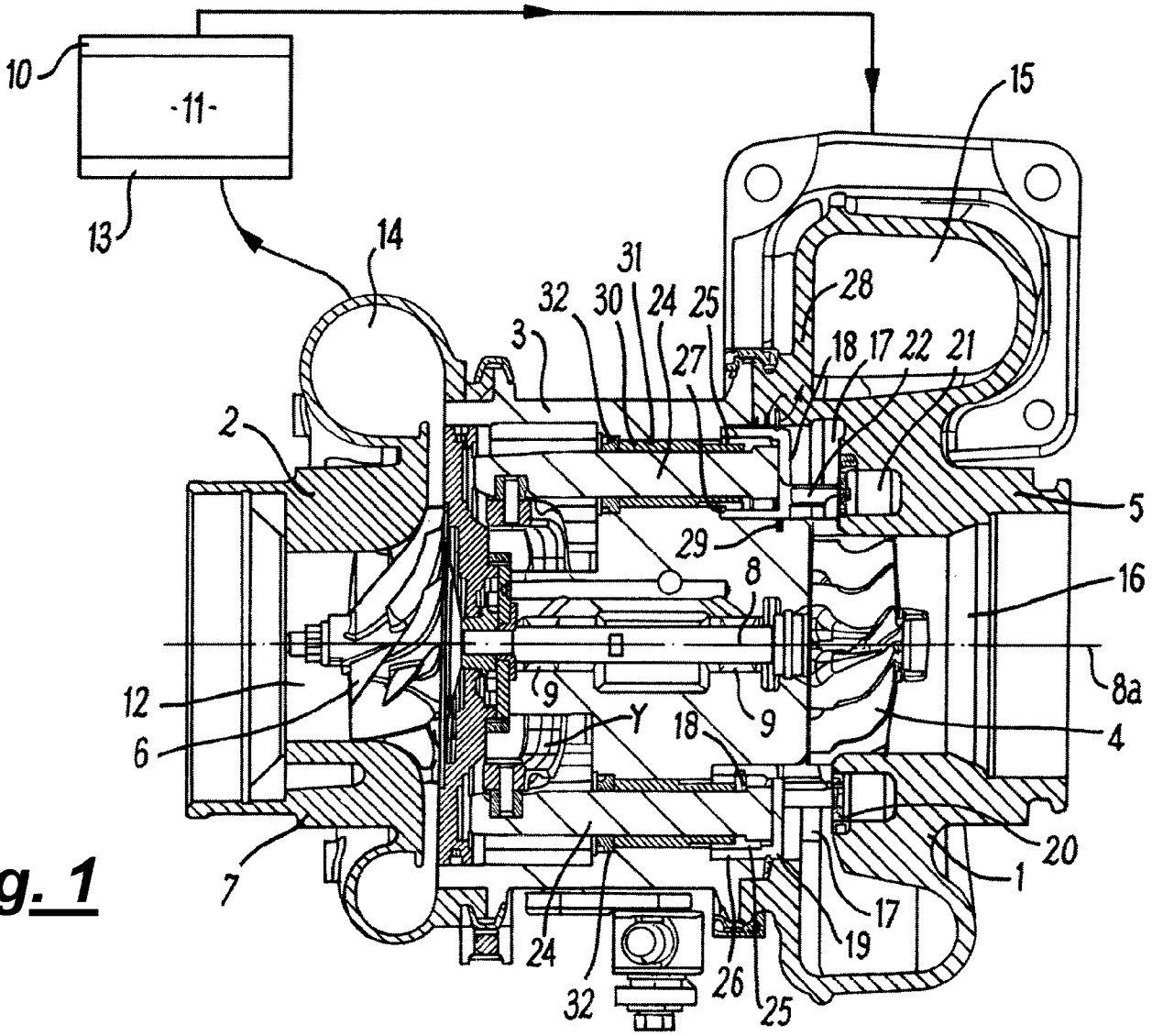
FIG. 1 is a sectioned view of a turbocharger to which the present invention may be applied, the section taken through a plane that intersects the axis of rotation of the turbocharger shaft.

Referring to FIG. 1, the illustrated turbocharger comprises a turbine 1 joined to a compressor 2 via a central bearing housing 3. The turbine 1 comprises a turbine wheel 4 rotating within a turbine housing 5. Similarly, the compressor 2 comprises a compressor impeller 6 that rotates within a compressor housing 7. The turbine wheel 4 and compressor impeller 6 are mounted on opposite ends of a common turbocharger shaft 8 that extends through the central bearing housing 3.

As is conventional, the bearing housing 3 has a central portion which houses journal bearing assemblies 9 located towards the compressor and turbine ends of the bearing housing respectively.

In use, the turbine wheel 4 is rotated about axis 8*a* by the passage of exhaust gas passing over it from the exhaust manifold 10 of an internal combustion engine 11. This in turn rotates the compressor wheel 6 that draws intake air through a compressor inlet 12 and delivers boost air to the inlet manifold 13 of the internal combustion engine via an outlet volute 14.

The turbine housing 5 defines an inlet chamber 15 (typically a volute) to which the exhaust gas from the exhaust manifold 10 of the internal combustion engine 11 is delivered. The exhaust gas flows from the inlet chamber 15 to an axially extending outlet passageway 16 via an annular inlet passageway 17 and the turbine wheel 4. The inlet passageway 17 is defined on one side by the face of a radially extending annular wall 18 of a movable nozzle ring 19 and on the opposite side by an annular shroud plate 20. The shroud plate 20 covers the opening of an annular recess 21 in the turbine housing 5.

The nozzle ring 19 has an array of circumferentially and equally spaced inlet vanes 22 each of which extends axially across the inlet passageway 17 from the radially extending wall 18. The vanes 22 are orientated to deflect gas flowing through the inlet passageway towards the direction of rotation of the turbine wheel 4. The vanes 22 project through suitably configured slots in the shroud plate 20, into the recess 21. The exterior surfaces of the vanes 22 are in close proximity to the edges of the slots so as to prevent any significant flow of gas into the recess 21 when the nozzle ring 19 is proximate the shroud plate 20.

The speed of rotation of the turbine wheel 4 is dependent upon the velocity of the gas passing through the annular inlet passageway 17. For a fixed rate of mass of gas flowing into the inlet passageway, the gas velocity is a function of the gap between the radial wall 18 of the nozzle ring 19 and the shroud plate 20, which gap defines the passageway 17 and is adjustable by controlling the axial position of the nozzle ring (as the inlet passageway 17 gap is reduced, the velocity of the gas passing through it increases).

The nozzle ring 19 is movable by an actuator (not shown) in an axial direction within a chamber 25 defined in the bearing housing 3 on a pair of diametrically opposed support rods 24. The rods 24 extend in the bearing housing 3 in a direction that is substantially parallel to the turbocharger shaft axis 8*a* and are arranged to translate in that direction. As well as the radially extending wall 18, the nozzle ring 19 has two spaced axially extending walls 26, 27 that are sealed against the walls of the chamber 25 by seals 28, 29. It will thus be understood that the nozzle ring 19 operates very much in the manner of a piston slidably disposed in a piston chamber (the chamber 25).

Figure 2:
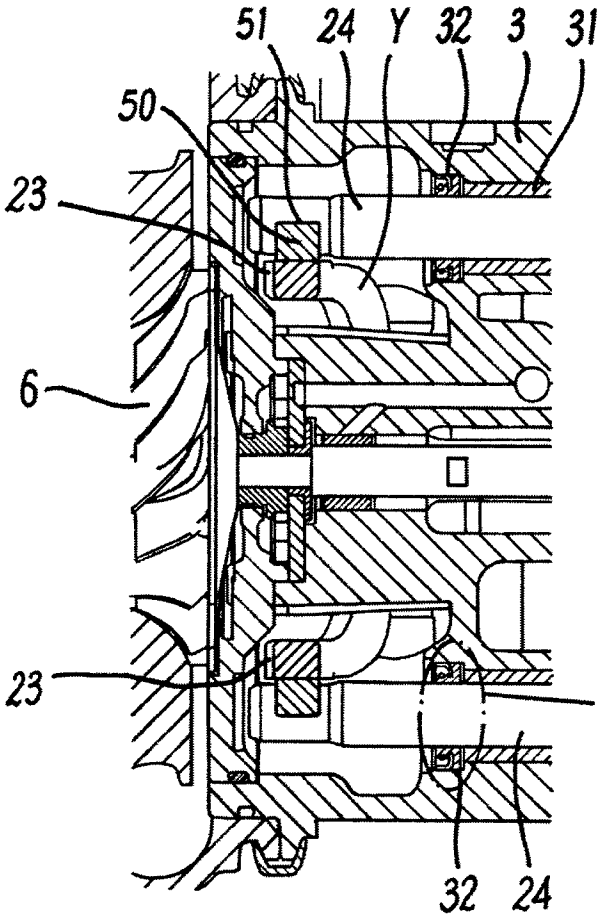
Fig. 2 (Prior Art)
FIG. 2 is a scrap view of part of a prior art turbocharger similar to that of FIG. 1, illustrating one end of the rods on which a nozzle ring is supported.

A drive mechanism for controlling the axial position of the rods the rods 24 and therefore the position of the nozzle ring 19 is visible in FIG. 1 and shown in more detail in FIG. 2. The mechanism comprises the actuator (not shown) and a transmission mechanism, which in this instance takes the form of a yoke Y that defines two spaced apart arms 23 that extend on opposite sides of the turbine axis 8*a* and connect to the rods 24. The end of each arm 23 has a pin that extends into a sliding block 50 that is in turn received in a slot 51 defined in a respective rod 24. Operation of the actuator causes pivoting movement of the yoke Y which is converted into translation of the rods 24 and therefore the nozzle ring 19. It is to be appreciated that the drive mechanism may take any suitable form for effecting translation of the nozzle ring 19. The actuator may be, for example, a pneumatic actuator or an electric motor with gears.

Each rod 24 slides axially within a cylindrical guide bush 31 that is received in a corresponding bore 30 defined in the bearing housing 3. As can be seen in both FIGS. 2 and 3, at the end of the bearing housing 3 that is opposite nozzle ring 19, the bore 30 widens to accommodate an annular dynamic seal 32 that seals the rod 24 to the bearing housing 3. The seal 32, which is adjacent to and separate from the end of the guide bush 31, prevents the flow of oil along the rod 24 to the turbine housing 4.

The annular seal 32 has radially inner and outer surfaces and extends between the rod 24 and a surface defined by the bearing housing 3. The inner surface of the seal has a radially inwards directed lip 33 for contacting the outer surface of the rod 24, the lip 33 being biased into sealing contact by means of a garter spring 34 located on the radially outer surface.

As described above, the seal 32 is costly to install and is subjected to significant heat particularly during hot shut down of the turbocharger. It is also difficult to inspect the seal during quality control procedures or maintenance routines.

Figure 3:
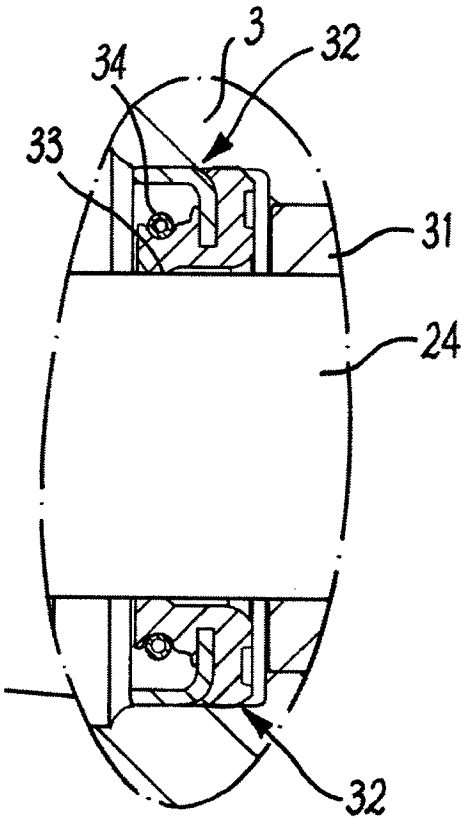
Fig. 3 (Prior Art)
FIG. 3 is an enlarged view of part of FIG. 2, illustrating seals associated with the rods.
Figure 4:
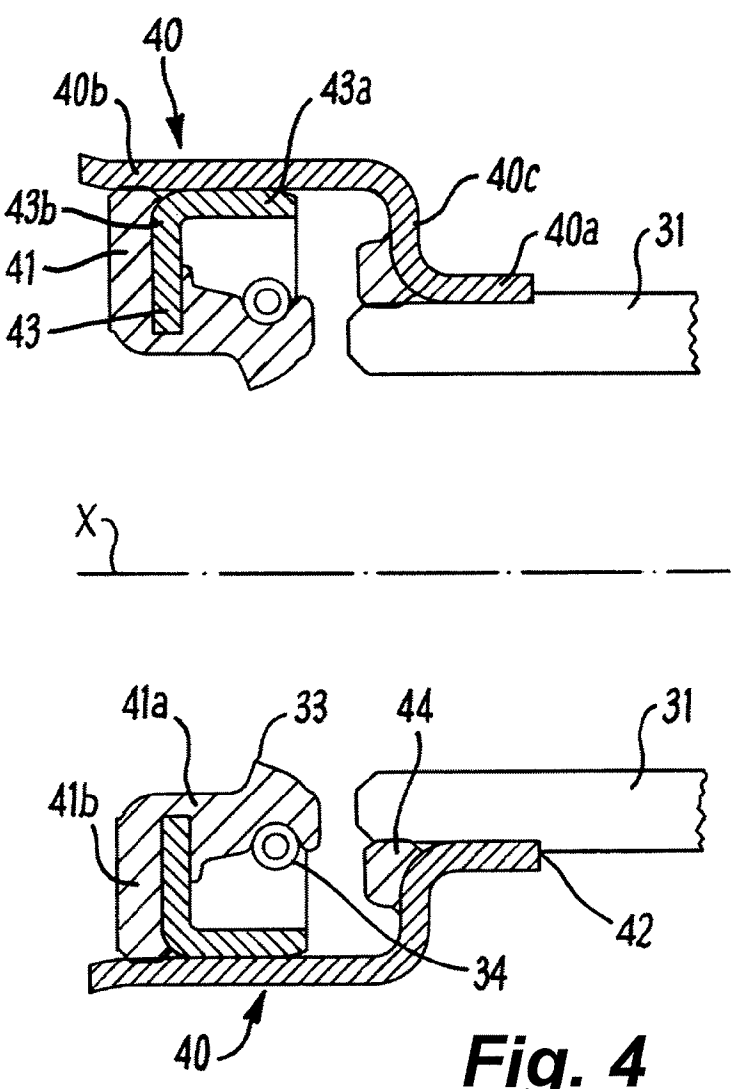
FIG. 4 is a sectioned view of a seal assembly in accordance with a first embodiment of the present invention.

An improved seal assembly in accordance with an embodiment of the present invention is shown in FIG. 4. This assembly is intended to replace that shown in FIGS. 1 to 3 and is accommodated at the same location within the turbocharger. Components which correspond to those of the embodiments of FIGS. 1 to 3 are given the same reference numerals and are not described in detail except in so far as they differ from their counterparts.

Each seal assembly is removably connected to one end of a guide bush 31 and comprises a seal carrier 40 in the form of a stepped hollow tube. A first portion 40*a* of the tube, defined at one end and extending a direction parallel to the longitudinal axis, X, of the guide bush 31, is supported on the end of a guide bush 31 by means of a press or interference fit. More particularly, the inner surface of the first portion 40*a* has a diameter that is slightly smaller that the diameter of the outer surface of the end of the guide bush 31. A second portion 40*b*, again extending in the axial direction, has a larger diameter and has an internal surface on which a lip seal 41 is supported. An integral intermediate portion 40*c*, which extends in a substantially radial direction with respect to the guide bush 31, interconnects the first and second portions 40*a*, 40*b* of the seal carrier.

The end of the guide bush 31 that supports the seal carrier 40 may have a diameter that is slightly smaller than that of the rest of the guide bush. A stepped transition between the two diameters defines an annular stop surface 42 that prevents the seal carrier 40 from travelling too far along the bush. In an alternative embodiment (not shown) an annular stop surface may be provided on the bearing housing for abutment with a suitable part of the seal carrier to achieve the same purpose. The annular stop surface on the bearing housing may be produced by machining a counter bore in the housing to a suitable depth.

The lip seal 41 is bonded to an annular strengthening web 43 that, in turn, is coupled to the seal carrier 40. The strengthening web 43 has an L-shaped cross-section with first and second substantially perpendicular limbs. A first limb 43*a*, which extends in a direction substantially parallel to the first and second portions 40*a*, 40*b* of the carrier, has an outer surface that bears against the inner surface of the second portion 40*b* of the seal carrier 40 in a press fit or interference fit. A second limb 43*b*, which extends radially inwards, supports the lip seal 41.

The lip seal 41 is generally annular with an inner portion 41*a* that extends in an axial direction and an outer portion 41*b* that extends radially outwards from one end. A radially inner surface of the seal defines an annular lip 33 for sealing engagement with the outer surface of the rod 24. The lip 33 projects inwardly to a diameter that is radially inboard of the diameter of the inside surface of the guide bush 31. The outer portion 41*b* of the lip seal 41 is bonded to the strengthening web 43 and abuts the second portion 40*b* of the seal carrier 40 at an end distal from the guide bush 31.

A garter spring 34 is disposed around a radially outer surface of the axially extending inner portion at a position that is substantially axially aligned with lip 33. The spring 34 urges the lip 33 radially inwards into contact with the rod 24 with a force that is sufficient to provide effective sealing yet permits translation of the rod 24 relative to the seal 41.

A small rubber annular seal 44 is supported on the end of the guide bush 31 and on the intermediate portion 40*c* of the seal carrier 40 prevents oil passing between the carrier 40 and the guide bush 31.

Figure 5:
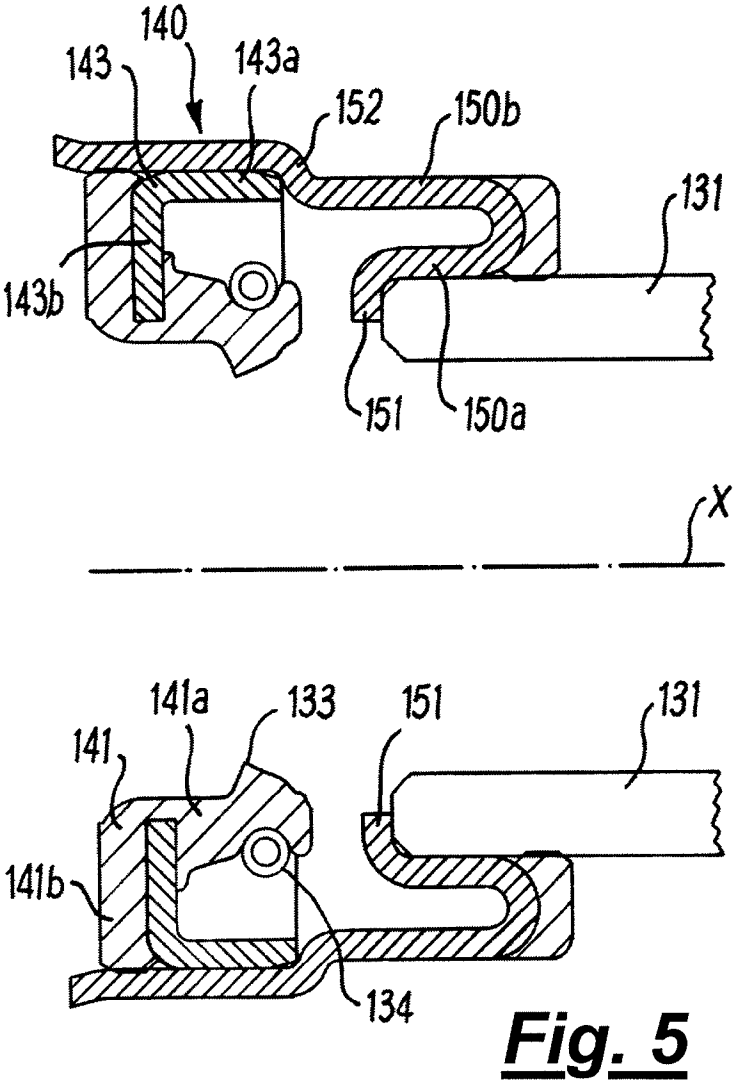
FIG. 5 is a sectioned view of a seal assembly in accordance with a second embodiment of the present invention.

A second exemplary embodiment of the seal assembly is shown in FIG. 5. Components which correspond to those of FIG. 4 are given the same reference numerals but increased by 100 and are not described in detail except in so far as they differ from their counterparts.

In this version the seal carrier 140 is again in the form of a hollow tube but one end is inwardly turned through substantially 180 degrees so as to define axially extending inner and outer portions 150*a*, 150*b*. The inner portion 150*a*, defined by the in-turned end, is supported on the outer surface of an end of the guide bush 131 in an interference or press fit. A terminal flange 151 extends radially inwards and abuts the end surface of the bush 131, thereby providing a stop surface. The outer portion 150*b* supports the lip seal 141 in the same manner as that described in relation to the preceding embodiment. The only difference is that the outer portion 150*b* is stepped radially inwards so as to define a shoulder 152 against which a free end of the first limb 143*a* of the strengthening web 143 may bear.

Figure 6:
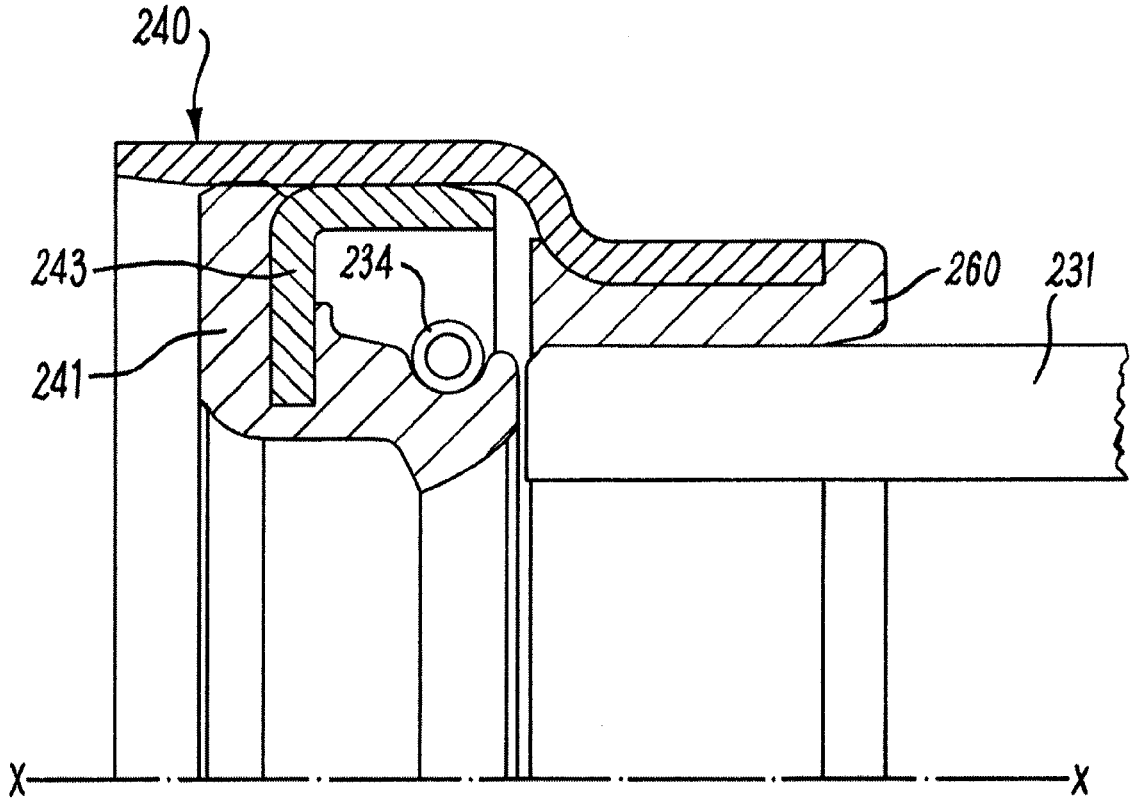
FIG. 6 is a sectioned view of part of a seal assembly in accordance with a third embodiment of the present invention.

A third exemplary embodiment of the seal assembly is shown in FIG. 6. Only the top half of the assembly is shown; the bottom half being a mirror image about the central axis X-X. Components which correspond to those of FIG. 4 are given the same reference numerals but increased by 200 and are not described in detail except in so far as they differ from their counterparts. In this design variant the inner diameter of the seal carrier 240 is lined with a sleeve 260 of thermal insulating material at the end where it is supported on the guide bush 231. Thus the seal carrier 240 and the guide bush 231 are radially separated by the sleeve 260. In this particular embodiment the sleeve 260 is moulded over the end of the seal carrier but it will be appreciated that it may be otherwise formed and fixed. The sleeve 260 serves to isolate the seal carrier 240, and hence the seal 241, from the heat conducted from the bearing housing via the guide bush 231. The sleeve may be made of any suitable insulating polymer including a rubber-based compound.

It will be appreciated that the end of the guide bush 231 that supports the seal carrier 240 may have a diameter that is slightly smaller than that of the rest of the guide bush in the same manner as the embodiment of FIG. 4. The sleeve 260 would be located on the reduced diameter portion. A stepped transition between the two diameters would define an annular stop surface that prevents the sleeve 260 and therefore the seal carrier 40 from travelling too far along the bush.

The seal carrier in each embodiment may be formed from any suitable material such as metal. In one embodiment it has a lower thermal conductivity than that of the bearing housing so as to provide some measure of thermal isolation. The carrier may have an internal cavity, at least in the region of the lip seal, for receipt of oil so as to provide for cooling of the seal. The oil may be permanently sealed in the cavity or may flow through it. The internal cavity may be provided by, for example, moulding or otherwise forming the carrier such that it has a double wall. The provision of an oil-filled cavity would provide cooling of the seal, particularly during hot shut down conditions.

In order to accommodate the seal assembly of FIG. 4, 5, or 6, the bearing housing 3 of FIG. 1 is modified. In particular, the bores 30 that house the guide bushes 31, 131, 231 are each provided with a counterbore of a diameter suitable for receiving the seal carrier 40, 140, 240. The counterbores are preferably produced as part of the casting process but may be otherwise provided by, for example, machining.

The provision of a separate seal carrier provides for a low cost sealing assembly that affords simpler assembly and installation. In particular, the lip seal 41, 141, 241 (with strengthening web 43, 143, 243) is first placed inside the seal carrier 40, 140, 240 which is then located on the end of the guide bush 31, 131, 231 by a sliding movement. If necessary the carrier 40, 140, 240 can be pressed into place by using an appropriate tool. In the embodiments of FIGS. 4 and 5 the stop surfaces 42, 151, ensure that the carrier is prevented from sliding over the guide bush too far in the axial direction. In the embodiment of FIG. 6 a stop surface may be provided or the sleeve 260 may provide sufficient friction to prevent significant axial movement.

Moreover, the seal carrier 40, 140, 240 eliminates direct contact between the lip seal 41, 141, 241 or the strengthening web 43, 143, 243 and the bearing housing 3 thus restricting the amount of heat reaching the lip seal 41, 141, 241.

The carrier 40, 140, 240 ensures that the lip seal 41, 141, 241 is not damaged during assembly as it is first located inside the seal carrier 40, 140, 240 before the seal assembly is installed. The ability to separate the lip seal 41, 141, 241 from the carrier 40, 141, 241 or the carrier from the guide bush allows the seal to be removed easily for inspection in a quality control or maintenance procedure, without damage to the seal.

The carrier 40, 141, 241 eliminates the need for accurate machining of the cast bearing housing to ensure that the seal is located with precision. The coupling of the seal carrier to the guide bush 31, 131, 231 ensures the seal 41, 141, 241 is concentrically disposed relative to the rod.

The outer surface of the seal carrier 40, 140, 240 may project out of the counterbore such that its outer surface is exposed to oil that splashes in the bearing housing. The oil serves to cool the seal carrier and therefore the lip seal 41, 141, 241.

It will be appreciated that numerous modifications to the above described design may be made without departing from the scope of the invention as defined in the appended claims. For example, the seal carrier 40, 140, 240 may be releasably coupled to the guide bush in any convenient manner. Similarly the strengthening web 43, 143, 243 may be coupled to the seal carrier, in a releasable fashion or otherwise, in any convenient manner. Moreover seals other than lip seals may be used and the seal (whether a lip seal or otherwise) may take any suitable form. Furthermore, any suitable biasing member may be used in place of the garter spring. In one embodiment this may be, for example, an elastomeric member. In another embodiment, a separate biasing member is not required and the biasing force may be inherent in the material of the seal.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A variable geometry turbine comprising a turbine wheel mounted within a housing for rotation about a turbine axis, a gas flow inlet passage upstream of said turbine wheel, and a gas flow control mechanism located upstream of the turbine wheel and operable by an actuator assembly to control gas flow through said inlet passage, the control mechanism comprising a movable member for varying the size of the inlet passage, the movable member being coupled to at least one support member, a guide member providing support for movement of the at least one support member in translation, a seal assembly for sealing against the at least one support member, the seal assembly comprising a seal carrier coupled to the guide member, the seal carrier carrying a seal that is in sealing contact with the at least one support member, wherein the seal carrier is coupled to the guide member via an intermediate member that is made of a thermally insulating material.

2. A variable geometry turbine according to claim 1, wherein the seal carrier is releasably coupled to the guide member.

3. A variable geometry turbine according to claim 1, wherein the seal carrier has a first portion that is coupled to the guide member.

4. A variable geometry turbine according to claim 3, wherein the seal carrier has a second portion for supporting the seal.

5. A variable geometry turbine according to claim 1, wherein the seal carrier or the guide member defines a stop surface for limiting axial relative movement of the seal carrier and the guide member.

6. A variable geometry turbine according to claim 1, wherein the support member is translatable in a direction substantially parallel to the turbine axis.

7. A variable geometry turbine according to claim 1, wherein the seal comprises a radially inner portion and a radially outer portion.

8. A variable geometry turbine according to claim 7, wherein the outer portion of the seal is supported on a strengthening member.

9. A variable geometry turbine according to claim 8, wherein the strengthening member comprises a first portion coupled to the seal carrier and a second portion that supports the seal.

10. A variable geometry turbine according to claim 1, wherein the guide member is disposed in a bore in a housing.

11. A variable geometry turbine according to claim 1, wherein the seal carrier is supported on the guide member.

12. A turbomachine comprising a variable geometry turbine according to claim 1.

13. A variable geometry turbine comprising a turbine wheel mounted within a housing for rotation about a turbine axis, a gas flow inlet passage upstream of said turbine wheel, and a gas flow control mechanism located upstream of the turbine wheel and operable by an actuator assembly to control gas flow through said inlet passage, the control mechanism comprising a movable member for varying the size of the inlet passage, the movable member being coupled to at least one support member, a guide member providing support for movement of the at least one support member in translation, a seal assembly for sealing against the at least one support member, the seal assembly comprising a seal carrier coupled to the guide member, the seal carrier carrying a seal that is in sealing contact with the at least one support member, wherein the seal carrier has a first portion that is coupled to the guide member, wherein the seal carrier has a second portion for supporting the seal, and wherein the first and second portions extend in a direction substantially parallel to the turbine axis.

14. A variable geometry turbine according to claim 13, wherein the first portion of the seal carrier is coupled to a first end of the guide member.

15. A variable geometry turbine according to claim 13, wherein the second portion of the seal carrier has a diameter that is larger than the diameter of the first portion.

16. A variable geometry turbine comprising a turbine wheel mounted within a housing for rotation about a turbine axis, a gas flow inlet passage upstream of said turbine wheel, and a gas flow control mechanism located upstream of the turbine wheel and operable by an actuator assembly to control gas flow through said inlet passage, the control mechanism comprising a movable member for varying the size of the inlet passage, the movable member being coupled to at least one support member, a guide member providing support for movement of the at least one support member in translation, a seal assembly for sealing against the at least one support member, the seal assembly comprising a seal carrier coupled to the guide member, the seal carrier carrying a seal that is in sealing contact with the at least one support member, wherein the seal comprises a radially inner portion and a radially outer portion, wherein the outer portion of the seal is supported on a strengthening member, and wherein the strengthening member comprises a first portion coupled to the seal carrier and a second portion that supports the seal.

17. A variable geometry turbine according to claim 16, wherein the strengthening member is releasably coupled to the seal carrier.

18. A variable geometry turbine comprising a turbine wheel mounted within a housing for rotation about a turbine axis, a gas flow inlet passage upstream of said turbine wheel, and a gas flow control mechanism located upstream of the turbine wheel and operable by an actuator assembly to control gas flow through said inlet passage, the control mechanism comprising a movable member for varying the size of the inlet passage, the movable member being coupled to at least one support member, a guide member providing support for movement of the at least one support member in translation, a seal assembly for sealing against the at least one support member, the seal assembly comprising a seal carrier coupled to the guide member, the seal carrier carrying a seal that is in sealing contact with the at least one support member, wherein the seal comprises a radially inner portion and a radially outer portion, wherein the outer portion of the seal is supported on a strengthening member, and wherein the strengthening member is releasably coupled to the seal carrier.

19. A variable geometry turbine comprising a turbine wheel mounted within a housing for rotation about a turbine axis, a gas flow inlet passage upstream of said turbine wheel, and a gas flow control mechanism located upstream of the turbine wheel and operable by an actuator assembly to control gas flow through said inlet passage, the control mechanism comprising a movable member for varying the size of the inlet passage, the movable member being coupled to at least one support member, a guide member providing support for movement of the at least one support member in translation, a seal assembly for sealing against the at least one support member, the seal assembly comprising a seal carrier coupled to the guide member, the seal carrier carrying a seal that is in sealing contact with the at least one support member, wherein the guide member is disposed in a bore in a housing, and wherein the seal carrier has a thermal conductivity that is lower than that of the housing.

20. A variable geometry turbine according to claim 19, wherein an outer surface of the seal carrier abuts a surface of the housing.

* * * * *